United States Patent [19]

Occelli

[11] Patent Number: 4,708,786

[45] Date of Patent: Nov. 24, 1987

[54] PROCESS FOR THE CATALYTIC CRACKING OF NITROGEN-CONTAINING FEEDSTOCKS

[75] Inventor: Mario L. Occelli, Yorba Linda, Calif.

[73] Assignee: Union Oil Company of California, Los Angeles, Calif.

[21] Appl. No.: 844,136

[22] Filed: Mar. 26, 1986

[51] Int. Cl.[4] ..... C10G 11/18; C10G 29/16

[52] U.S. Cl. ..... 208/120; 208/121; 208/122; 208/254 R

[58] Field of Search ..... 208/120, 113, 254 R, 208/121, 122, 118; 585/820, 823; 502/515

[56] References Cited

U.S. PATENT DOCUMENTS

| | | | |
|---|---|---|---|
| 2,800,427 | 7/1957 | Junk, Jr. et al. | 208/254 R |
| 2,925,375 | 2/1960 | Fleck et al. | 208/254 R |
| 2,925,381 | 2/1960 | Fleck et al. | 208/254 R |
| 2,962,435 | 11/1960 | Fleck et al. | 208/119 |
| 4,090,948 | 5/1978 | Schwarzenbek | 208/120 |
| 4,125,457 | 11/1978 | Brennan et al. | 208/254 R |
| 4,137,154 | 1/1979 | Audeh | 208/254 R |
| 4,289,605 | 9/1981 | Bartholic | 208/113 |
| 4,289,606 | 9/1981 | Gladrow et al. | 208/120 |
| 4,368,114 | 1/1983 | Chester et al. | 208/120 ML |
| 4,390,416 | 6/1983 | Ritter et al. | 208/120 |
| 4,416,765 | 11/1983 | Chester et al. | 208/120 |
| 4,428,825 | 1/1984 | Ward et al. | 208/109 |
| 4,434,147 | 2/1984 | Dimpfl et al. | 208/254 R |
| 4,465,588 | 8/1984 | Occelli et al. | 208/113 |
| 4,490,241 | 12/1984 | Chou | 208/120 |
| 4,615,996 | 10/1986 | Occelli | 208/120 |
| 4,650,564 | 3/1987 | Occelli et al. | 208/113 |

FOREIGN PATENT DOCUMENTS

| | | | |
|---|---|---|---|
| 2116062 | 9/1983 | United Kingdom | 208/120 |
| 2145345 | 3/1985 | United Kingdom | 208/120 |

OTHER PUBLICATIONS

C. Marcilly and J. P. Franck, "Use of Zeolite Containing Catalysts in Hydrocracking," *Catalysis by Zeolites*, Elsevier Scientific Publishing Company, Amsterdam, pp. 93–104, (1980).

J. W. Scott and A. G. Bridge, "The Continuing Development of Hydrocracking," *Advances in Chemistry Series* 103, American Chemical Society, Washington, D.C., pp. 113–129, (1971).

G. A. Mills, E. R. Boedeker and A. G. Oblad, "Chemical Characterization of Catalysts. I. Poisoning of Cracking Catalysts by Nitrogen Compounds and Potassium Ion," *Journal of American Chemical Society, vol. 72, pp. 1554–1560, (1950).*

*Primary Examiner*—Andrew Metz
*Assistant Examiner*—Anthony McFarlane
*Attorney, Agent, or Firm*—Yale S. Finkle; Gregory F. Wirzbicki; Dean Sandford

[57] ABSTRACT

Hydrocarbon feedstocks containing relatively high levels of nitrogen contaminants are converted by catalytic cracking to products of lower average molecular weight by contacting the feedstock with a mixture of a cracking catalyst and separate particles of a nitrogen scavenger. The nitrogen scavenger is a particulate solid acid capable of sorbing pyridine at room temperature and retaining greater than about 5 weight percent of the sorbed pyridine after heating in a vacuum to about 300° C. Examples of the nitrogen scavengers that can be used in the process include amorphous aluminosilicates, nonzeolitic molecular sieves such as pillared clays and delaminated clays; and zeolitic molecular sieves.

44 Claims, No Drawings

PROCESS FOR THE CATALYTIC CRACKING OF NITROGEN-CONTAINING FEEDSTOCKS

BACKGROUND OF THE INVENTION

This invention relates to a catalytic cracking process and is particularly concerned with the cracking of feedstocks containing substantial quantities of nitrogen-containing compounds.

Fluidized catalytic cracking (FCC) units are used in the petroleum industry to convert high boiling hydrocarbon feedstocks to more valuable hydrocarbon products, such as gasoline, having a lower average molecular weight and a lower average boiling point than the feedstocks from which they were derived. The conversion is normally accomplished by contacting the hydrocarbon feedstock with a moving bed of catalyst particles at temperatures ranging between about 800° F. and about 1100° F. The most typical hydrocarbon feedstock treated in FCC units comprises a heavy gas oil, but on occasions such feedstocks as light gas oils or atmospheric gas oils, naphthas, reduced crudes and even whole crudes are subjected to catalytic cracking to yield low boiling hydrocarbon products.

Catalytic cracking in FCC units is generally accomplished by a cyclic process involving separate zones for catalytic reaction, steam stripping, and catalyst regeneration. The hydrocarbon feedstock is blended with an appropriate amount of catalyst particles to form a mixture that is then passed through a catalytic reactor, normally referred to as a riser, wherein the mixture is subjected to a temperature between about 800° F. and about 1100° F. in order to convert the feedstock into gaseous, lower boiling hydrocarbons. After these gaseous, lower boiling hydrocarbons are separated from the catalyst in a suitable separator, such as a cyclone separator, the catalyst, now deactivated by coke deposited upon its surfaces, is passed to a stripper. Here the deactivated catalyst is contacted with steam to remove entrained hydrocarbons that are then combined with vapors exiting the cyclone separator to form a mixture that is subsequently passed downstream to other facilities for further treatment. The coke-containing catalyst particles recovered from the stripper are introduced into a regenerator, normally a fluidized bed regenerator, where the catalyst is reactivated by combusting the coke in the presence of an oxygen-containing gas, such as air, at a temperature which normally ranges between about 1000° F. and about 1500° F. The cyclic process is then completed by blending the reactivated catalyst particles with the feedstock entering the riser or reaction zone of the FCC unit.

It is well known that catalytic cracking feedstocks which contain high levels of nitrogen have a deleterious effect on cracking catalysts. The nitrogen is typically present in the form of basic organic compounds, primarily aromatic compounds containing nitrogen heteroatoms such as pyridines, indoles and quinolines, which are strongly sorbed on the acidic sites of the cracking catalyst. The basic nitrogen compounds react with the acidic sites, thereby neutralizing the sites and decreasing the activity of the catalyst. This deactivation results in decreased conversions and gasoline production. Levels of nitrogen in the feedstock as small as 0.01 weight percent, calculated as the element, can result in some decrease in activity of the catalyst; however, significant deactivation is not normally encountered unless the concentration of nitrogen in the feedstock increases to about 0.08 weight percent or above. Nitrogen poisoning of cracking catalysts is quite severe when the feedstock is a synthetic oil derived from carbonaceous solids such as oil shale, coal, tar sands and the like. Such synthetic oils tend to have relatively high concentrations of nitrogen, sometimes ranging as high as 5.0 weight percent, calculated as the element.

In order to avoid substantial deactivation of cracking catalysts by nitrogen compounds in feedstocks containing high levels of nitrogen, it has been standard practice to treat such feedstocks to reduce the concentration of nitrogen compounds prior to subjecting the feedstocks to catalytic cracking. Techniques employed in the past for removing the nitrogen compounds from the feedstocks include (1) adsorbing the compounds on solid material such as silica, alumina or various grades of clay, (2) treating the feedstock with mineral acids to form water-soluble salts of the basic nitrogen compounds, which salts can readily be removed from the feedstock, and (3) treating the feedstock in the presence of added hydrogen with a hydrogenation catalyst. Of these three techniques, the latter one, hydroprocessing, is the one most frequently used. However, in order to remove substantial quantities of residual nitrogen, hydrogenation pressures up to 5000 p.s.i.g. are typically required. Installation of equipment to carry out such a high pressure process requires a substantial capital investment. The other two techniques also have disadvantages in that they too require the installation of additional equipment and are not always able to remove as much nitrogen as desired.

Accordingly, it is one of the objects of the present invention to provide a fluid catalytic cracking process for treating feedstocks that contain relatively high concentrations of nitrogen constituents while maintaining the activity of the catalyst at a reasonable level. It is another object of the invention to provide such a process without the necessity of first treating the feedstock to remove substantially all or a portion of the nitrogen-containing compounds. These and other objects of the invention will become more apparent in view of the following description of the invention.

SUMMARY OF THE INVENTION

In accordance with the invention, it has now been found that the deleterious effects of nitrogen constituents on the activity and selectivity of a catalytic cracking catalyst comprising a molecular sieve having cracking activity dispersed in a matrix or binder can be substantially avoided by mixing the catalyst with separate particles of a nitrogen scavenger that preferentially sorbs the nitrogen compounds. The solid nitrogen scavenger can be any microporous solid capable of sorbing pyridine at room temperature and retaining greater than about 5 weight percent of the sorbed pyridine after the solid has been heated in a vacuum to about 300° C. Examples of preferred nitrogen scavengers include amorphous aluminosilicates, heat stable metal compounds selected from the group consisting of magnesium, calcium, phosphorus, zirconium, boron and tungsten compounds either alone or in combination with an inorganic refractory oxide such as silica or alumina, crystalline zeolitic molecular sieves, and nonzeolitic molecular sieves such as borosilicates, galliosilicates, pillared clays, delaminated clays, silicoaluminophosphates, and aluminophosphates.

It has been found that hydrocarbon feedstocks containing substantial concentrations of nitrogen compounds can be effectively subjected to catalytic cracking without prior treatment to remove the nitrogen compounds by replacing between about 5 and about 60 weight percent of the normal catalyst inventory in an FCC unit with a nitrogen scavenger as described above. It has been specifically found that, when cracking a feedstock containing 0.26 weight percent total nitrogen, calculated as the element, an increase in gasoline yield from 56.0 volume percent to 62.7 volume percent, a significant and unexpectedly high increase, can be achieved by replacing 10 weight percent of Nova-D commercial cracking catalyst, which is manufactured and sold by the Davison Chemical Division of W. R. Grace & Co., with separate particles of an amorphous aluminosilicate containing 55 weight percent alumina and 45 weight percent silica.

In general, the feedstock to the process of the invention will contain greater than about 0.08 weight percent total nitrogen, calculated as the element, typically between about 0.10 and about 5.0 weight percent depending on whether the feedstock is a petroleum based feedstock or a synthetic oil derived from oil shale, coal or similar carbonaceous solids. Normally, the feed is a gas oil derived from petroleum and containing between about 0.10 and about 0.50 weight percent total nitrogen, calculated as the element.

The process of the invention has many advantages over other catalytic cracking processes in that it allows for the processing of feedstocks containing relatively high concentrations of nitrogen without first having to install equipment to treat the feedstock prior to subjecting it to catalytic cracking. Moreover, the use of an inexpensive nitrogen scavenger in lieu of a portion of the more expensive cracking catalyst decreases the cost of the catalyst while significantly increasing the amount of gasoline produced from the nitrogen-containing feedstock.

DETAILED DESCRIPTION OF THE INVENTION

In accordance with this invention, a fluidized catalytic cracking (FCC) process, or other cyclic catalytic cracking process, in which a hydrocarbon feedstock containing nitrogen compounds is refined to produce low-boiling hydrocarbon products by passing the feedstock in contact with a cracking catalyst through a catalytic cracking reaction zone in the substantial absence of added molecular hydrogen is improved by introducing a nitrogen sorbent or scavenger into the cyclic process to preferentially sorb nitrogen components from the feed and thereby prevent them from deactivating the cracking catalyst. In general, any molecular sieve possessing cracking activity at temperatures above 750° F. may be used as the acidic component of the cracking catalyst. The term "molecular sieve" as used herein refers to any material capable of separating atoms or molecules based on their respective dimensions. Molecular sieves suitable for use as a component of the cracking catalyst include pillared clays, delaminated clays, and crystalline aluminosilicates. Normally, it is preferred to use a cracking catalyst which contains a crystalline aluminosilicate. Examples of such aluminosilicates include Y zeolites, ultrastable Y zeolites, X zeolites, zeolite beta, zeolite L, offretite, mordenite, faujasite, and zeolite omega. The preferred crystalline aluminosilicates for use in the cracking catalyst are X and Y zeolites with Y zeolites being the most preferred. Such zeolites have a pore size of about 8.1 Angstroms. The term "pore size" as used herein refers to the diameter of the largest molecule that can be sorbed by the particular molecular sieve in question. The measurement of such diameters and pore sizes is discussed more fully in Chapter 8 of the book entitled "Zeolite Molecular Sieves" written by D. W. Breck and published by John Wiley & Sons in 1974, the disclosure of which book is hereby incorporated by reference in its entirety.

U.S. Pat. No. 3,130,007, the disclosure of which is hereby incorporated by reference in its entirety, describes Y-type zeolites having an overall silica-to-alumina mole ratio between about 3.0 and about 6.0, with a typical Y zeolite having an overall silica-to-alumina mole ratio of about 5.0. It is also known that Y-type zeolites can be produced, normally by dealumination, having an overall silica-to-alumina mole ratio above about 6.0. Thus, for purposes of this invention, a Y zeolite is one having the characteristic crystal structure of a Y zeolite, as indicated by the essential X-ray powder diffraction pattern of Y zeolite, and an overall silica-to-alumina mole ratio above 3.0, and includes Y-type zeolites having an overall silica-to-alumina mole ratio above about 6.0.

The stability and/or acidity of a zeolite used as a component of the cracking catalyst may be increased by exchanging the zeolite with ammonium ions, polyvalent metal cations, such as rare earth-containing cations, magnesium cations or calcium cations, or a combination of ammonium ions and polyvalent metal cations, thereby lowering the sodium content until it is less than about 0.8 weight percent, preferably less than about 0.5 weight percent and most preferably less than about 0.3 weight percent, calculated as $Na_2O$. Methods of carrying out the ion exchange are well known in the art.

The zeolite or other molecular sieve component of the catalyst is combined with a porous, inorganic refractory oxide matrix or binder to form a finished catalyst prior to use. The refractory oxide component in the finished catalyst may be silica-alumina, silica, alumina, natural or synthetic clays, pillared or delaminated clays, mixtures of one or more of these components and the like. Preferably, the inorganic refractory oxide matrix will comprise a mixture of silicaalumina and a nonpillared and nondelaminated clay such as kaolin, hectorite, sepiolite and attapulgite. A preferred finished catalyst will typically contain between about 5 weight percent and about 40 weight percent zeolite or other molecular sieve and greater than about 20 weight percent inorganic, refractory oxide. In general, the finished catalyst will contain between about 10 and about 35 weight percent zeolite or other molecular sieve, between about 10 and about 30 weight percent inorganic, refractory oxide, and between about 30 and about 70 weight percent nonpillared and nondelaminated clay.

The crystalline aluminosilicate or other molecular sieve component of the cracking catalyst may be combined with the porous, inorganic refractory oxide component or a precursor thereof by techniques including mixing, mulling, blending or homogenization. Examples of precursors that may be used include alumina, alumina sols, silica sols, zirconia, alumina hydrogels, polyoxycations of aluminum and zirconium, and peptized alumina. In a preferred method of preparing the cracking catalyst, the zeolite is combined with an aluminosilicate gel or sol or other inorganic, refractory oxide component, and the resultant mixture is spray dried to produce finished catalyst particles normally ranging in diameter between about 40 and about 80 microns. If desired, however, the zeolite or other molecular sieve may be mulled or otherwise mixed with the refractory oxide component or precursor thereof, extruded and then ground into the desired particles size range. Normally, the finished catalyst will have an average bulk density between about 0.30 and about 0.90 gram per cubic centimeter and a pore volume between about 0.10 and about 0.90 cubic centimeters per gram.

Cracking catalysts prepared as described above and containing zeolites or other molecular sieves normally become poisoned and severely deactivated for cracking when the nitrogen concentration of the hydrocarbon feedstock is greater than about 0.08 weight percent, calculated as the element. It has now been found that such deleterious effects on the cracking catalysts can be substantially avoided by replacing a portion of the cracking catalyst inventory in the FCC unit with separate particles of a nitrogen scavenger comprising a microporous solid capable of sorbing pyridine at room temperature and retaining greater than about 5 weight percent of the sorbed pyridine after being heated in a vacuum to about 300° C. Typically, the microporous solid is capable of retaining between about 5 and about 95 weight percent of the sorbed pyridine, preferably between about 10 and about 50 weight percent, after heating to about 300° C. at a pressure of about 0.10 torr. The microporous solid will also normally contain a significant amount of Bronsted acid sites. The presence of such sites in a solid is indicated by the appearance of bands at 1635–1637, 1542–1544 and 1488–1490 $cm^{-1}$ on an infrared spectrum of the solid taken after the solid has been saturated with pyridine. In general, the ratio of Bronsted acid sites to Lewis acid sites in the microporous solid will be greater than about 0.10, preferably greater than about 0.25. The greater the number of Bronsted acid sites in relation to Lewis acid sites, the more effective the solid will be as a nitrogen scavenger. The presence of Lewis acid sites in a solid is indicated by the appearance of bands at 1445–1453 and 1605–1620 $cm^{-1}$ on an infrared spectrum of the solid taken after the solid has been saturated with pyridine. The identification and measurement of Bronsted acid sites and Lewis acid sites is discussed in detail in the article entitled "An Infrared Study of Pyridine Adsorbed on Acid Sites—Characterization of Surface Acidity," by E. P. Parry and appearing in the *Journal of Catalysis*, Volume 2, page 371 (1963), the disclosure of which article is hereby incorporated by reference in its entirety.

Solids as described above are strongly acidic and it is believed that the basic nitrogen compounds in the hydrocarbon feedstock preferentially sorb on the surface of the microporous solids, thereby preventing such compounds from reacting with the acid cracking sites in the separate catalyst particles. The result is that the activity and selectivity of the catalyst are maintained at a relatively high level or increased even though the feedstock is relatively rich in nitrogen components.

Examples of microporous solids which may be used as the nitrogen scavenger in the process of the invention include amorphous aluminosilicates, crystalline zeolitic molecular sieves, heat stable metal compounds selected from the group consisting of magnesium, calcium, phosphorus, zirconium, boron and tungsten compounds either alone or in combination with an inorganic, refractory oxide such as silica or alumina, and nonzeolitic molecular sieves. The term "nonzeolitic molecular sieves" as used herein refers to molecular sieves whose frameworks are not formed of substantially only silica and alumina tetrahedra. The term "zeolitic molecular sieves" as used herein refers to molecular sieves whose frameworks are formed of substantially only silica and alumina tetrahedra such as the framework present in ZSM-5 type zeolites, Y zeolites and X zeolites. Amorphous aluminosilicates are the most preferred materials for use as a component of the nitrogen scavenger.

The amorphous aluminosilicates suitable for use as the nitrogen scavenger are mixtures of silica and alumina normally prepared by reacting a soluble silica compound or sol with a soluble aluminum compound. In a typical preparation procedure, a silica hydrogel is made by neutralizing a solution of sodium silicate. An alumina source, such as aluminum hydroxide, sodium aluminate, aluminum sulfate or aluminum nitrate, is then added to and reacted with the hydrogel to form an aluminosilicate gel. If desired, alumina and/or clay may be added to the aluminosilicate gel in order to adjust the density and increase attrition resistance of the nitrogen scavenger. The gel is filtered to remove some of the water and inorganic salts and the resultant filter cake is mixed with a controlled amount of water to provide a spray dryer feed slurry having appropriate properties. The slurry is then subjected to spray drying to produce microporous particles typically ranging in diameter between about 40 and about 80 microns. After spray drying, the particulate aluminosilicate is washed to remove soluble impurities. The resultant aluminosilicate will normally contain between about 5 and about 95 weight percent alumina, preferably between about 20 and about 80 weight percent, and between about 5 and about 95 weight percent silica, preferably between about 20 and about 80 weight percent silica. If clay is added to the aluminosilicate gel during manufacturing, it will normally be present in the finished microporous particles in an amount ranging between about 20 and about 80 weight percent, preferably between about 40 and about 60 weight percent. Aluminosilicates containing various concentrations of alumina and silica are available commercially from the American Cyanamid Company.

Heat stable metal compounds selected from the group consisting of magnesium, calcium, zirconium, phosphorus, boron and tungsten compounds are also useful as the nitrogen scavenger. The phrase "heat stable metal compounds" as used herein refers to compounds that will not decompose at temperatures extant in a FCC unit. Examples of such heat stable compounds include magnesium oxide, phosphorus oxide, boron oxide, zirconium oxide, tungsten oxide, and mixtures thereof. The heat stable metal compounds may be used alone or in combination with an inorganic, refractory oxide such as silica or alumina. Preferred combinations of heat stable metal compounds and inorganic, refractory oxides include amorphous silicoaluminophosphates, $Al_2O_3$-$AlPO_4$-$SiO_2$, $MgO$-$Al_2O_3$-$AlPO_4$ and $SiO_2$-$Al_2O_3$-$B_2O_3$. The latter three combinations are described, respectively, in U.S. Pat. Nos. 4,228,036, 4,179,558 and 2,579,133, the disclosures of which patents are hereby incorporated by reference in their entireties.

As mentioned previously, the nitrogen scavenger may also be a nonzeolitic molecular sieve. Examples of such sieves include crystalline aluminophosphates, crystalline silicoaluminophosphates, crystalline borosilicates, crystalline galliosilicates, crystalline silicas, pillared clays and delaminated clays. The various species of crystalline aluminophosphates which may be used as the nitrogen scavenger are designated by the acronym $AlPO_4$-n, where "n" denotes a specific structure type as identified by X-ray powder diffraction. The structure and preparation of the various species of aluminophosphates are discussed in U.S. Pat. Nos. 4,310,440 and 4,473,663, the disclosures of which are hereby incorporated by reference in their entirety. The crystalline silicoaluminophosphates which may be used as the nitrogen scavenger are referred to by the acronym SAPO-n where "n" denotes a specific structure type as identified by X-ray powder diffraction. The various species of crystalline silicoaluminophosphates are described in detail in U.S. Pat. No. 4,440,871, the disclosure of which is hereby incorporated by reference in its entirety. Crystalline borosilicates suitable for use as the nitrogen scavenger are described in U.S. Pat. Nos. 4,254,297, 4,269,813 and 4,327,236, the disclosures of which are hereby incorporated by reference in their entireties. Crystalline galliosilicates suitable for use as the nitrogen scavenger are described in detail in U.S. Pat. No. 3,431,219, the disclosure of which is hereby incorporated by reference in its entirety.

A preferred nonzeolitic molecular sieve which may be used as the nitrogen scavenger is a crystalline silica molecular sieve. Preferably, the crystalline silica molecular sieve is a silica polymorph. One highly preferred silica polymorph is known as silicalite and may be prepared by methods described in U.S. Pat. No. 4,061,724, the disclosure of which is hereby incorporated by reference in its entirety. The resulting silicalite may be subjected to combustion to remove organic materials and then treated to eliminate traces of alkali metal ions. Unlike the "ZSM family" of zeolites, silicalite is not an aluminosilicate and contains only trace proportions of alumina derived from reagent impurities. These alumina impurities provide the silicalite with Bronsted acid sites which enable it to function as an effective nitrogen scavenger.

Two other types of nonzeolitic molecular sieves useful as the nitrogen scavenger in the process of the invention are pillared and delaminated clays. Pillared clays are formed by intercalating thermally stable, robust, three dimensional cations between the silicate layers of smectite clays. The shape and size of the intercalated cations allows them to serve as molecular pillars to prop apart the layers of the clay and thereby prevent them from collapsing. The fairly homogeneous distribution of pillars in the inner layered spaces of the clay form an array of rectangular openings, typically about 8 by 15 Angstroms in size, which enable the pillared clay to behave like a 2 dimensional sieve. By adjusting the size of the intercalated cations or the spacing between such cations, or both, the pore size of the pillared clay may be adjusted to suit a particular application. Pillared clays are typically prepared by intercalating montmorillonite, hectorite, and beidellite, the most common of the smectite clays, with polyoxycations or oxides, preferably polyoxycations of aluminum, zirconium, and mixtures of aluminum and zirconium. Pillared clays and their preparation are described more fully in the article entitled "Intercalated Clay Catalysts," *Science,* Volume 220, No. 4595, pp 365-371 (Apr. 22, 1983) and in U.S. Pat. Nos. 4,176,090, 4,248,739 and 4,216,188. The disclosures of the aforementioned article and patents are hereby incorporated by reference in their entireties. Preferably, a suitable pillared smectite clay for use as the nitrogen scavenger comprises a multiplicity of robust, three dimensional cations interposed between the molecular layers of a clay such that the spacing between the molecular layers ranges from about 6.0 to about 10 Angstroms and is maintained at such values when the clay is heated at a temperature of at least 350° C. in an air atmosphere for at least 2 hours.

The polyoxycations typically used to pillar smectite clays can also be used to delaminate certain types of clays. Unlike pillared clays in which the clay layers propped apart by cationic pillars are oriented face to face, the clay layers in a delaminated clay, some of which layers are propped apart by cationic pillars, contain edge-to-edge and edge-to-face linkages or connections which form a macrospace of the type found in amorphous aluminosilicate supports. Delaminated clays can be prepared by reacting Laponite, a synthetic hectorite manufactured by Laporte Industries, Ltd., with polyoxycations of aluminum in a manner described in the chapter entitled "Preparation and Properties of Pillared and Delaminated Clay Catalysts," authored by T. J. Pinnavaia and appearing in the book entitled *Heterogeneous Catalysis* edited by B. L. Shapiro and published by the Texas A&M University Press, College Station, Tex., page 142 (1984) and in the article entitled "On the Pillaring and Delamination of Smectite Clay Catalysts by Polyoxo Cations of Aluminum," authored by T. J. Pinnavia, M. S. Tzou, S. D. Landau, and R. H. Raythathe, and appearing at page 195 in the *Journal of Molecular Catalysis,* Volume 27, (1984). The disclosures of these two publications are hereby incorporated by reference in their entireties. If desired delaminated or pillared clays may be composited with amorphous aluminosilicates in order to improve the thermal and hydrothermal stability of these clays.

The nitrogen scavenger used in the process of the invention may also be a synthetic or naturally occurring zeolitic molecular sieve. Such zeolitic molecular sieves are preferably utilized in their hydrogen form or after ion exchange with polyvalent metal cations, such as rare earth cations, and will normally contain less than about 2.0 weight percent metal cations based upon the weight of the corresponding metal oxide, preferably less than about 0.5 weight percent. The hydrogen form of a synthetic zeolitic molecular sieve is typically prepared by ion exchanging the molecular sieve with ammonium ions in accordance with procedures well known in the art. The hydrogen form of naturally occurring zeolitic molecular sieves is preferably prepared by subjecting the sieve to repetitive treatments for short periods of time with mineral acids such as hydrochloric acid, nitric acid and sulfuric acid. Although the useful zeolitic molecular sieves include Y zeolites and X zeolites, which zeolites have a pore size of about 8.1 Angstroms, it is normally preferred to use a natural or synthetic zeolite having a pore size less than about 7.0 Angstroms, preferably less than about 6.5 Angstroms. Examples of naturally occurring zeolites having pore sizes less than 7.0 Angstroms that may be used as the nitrogen scavenger include offretite and ferrierite. Examples of synthetic zeolites having pore sizes below 7.0 Angstroms which may be used as the nitrogen scavenger in the process of the invention include crystalline aluminosilicates of the ZSM-5 type such as ZSM-5, ZSM-11, ZSM-12, ZSM-23, ZSM-35, ZSM-38 and the like. The latter six zeolites are all well-known and are more fully described, respectively, in the following U.S. patents, the disclosures of which are hereby incorporated by reference in their entireties: U.S. Pat. Nos. 3,702,886; 3,709,979; 3,832,449; 4,076,842; 4,016,245 and 4,046,859.

The purpose of the solid microporous acid used as the nitrogen scavenger in the process of the invention is to preferentially sorb nitrogen-containing compounds from the FCC unit feedstock, thereby preventing these compounds from poisoning the cracking catalyst by reacting with its acid sites. Since the purpose of the nitrogen scavenger is not to catalytically crack molecules of the feedstock, it is preferable that the scavenger be a solid diluent that possesses relatively low cracking activity in comparison to the cracking catalyst. The term "relatively low cracking activity" as used herein refers to an activity as defined by the following equation (1) which is less than about 2.0, preferably less than about 1.5 and most preferably less than about 1.0.

$$\text{activity} = \frac{\text{volume percent conversion}}{100 - \text{volume percent conversion}} \quad (1)$$

The value for volume percent conversion as used in equation (1) is determined by use of the standard mircoactivity test (MAT) method after the scavenger has been contacted with steam for 5 hours at a temperature between about 1000° F. and about 1550° F. The MAT method of measuring activity is discussed in detail in the article entitled "Microactivity Test for Cracking," authored by F. G. Ciapetta and D. Anderson and appearing in the *Oil & Gas Journal,* Volume 65, page 88 (1967), the disclosure of which article is hereby incorporated by reference in its entirety. The feed used for the MAT test is a gas oil containing less than about 0.08 weight percent total nitrogen and a combined total of less than 1.0 ppmw nickel, vanadium, copper and iron. The cracking catalyst will typically have an activity as measured by equation (1) which is greater than about 2.0, preferably greater than about 2.3, and most preferably greater than about 3.0.

As mentioned previously, the nitrogen scavenger is microporous and therefore has a relatively high surface area, preferably ranging between about 50 and about 700 square meters per gram, preferably between about 125 and about 500 square meters per gram. The total pore volume typically is in the range between about 0.15 and about 0.70 cubic centimeter per gram, preferably between about 0.20 and about 0.50 cubic centimeter per gram. The particle size of the nitrogen scavenger can vary over a wide range, but is preferably approximately the same size as the cracking catalyst, typically between about 30 and about 100 microns in diameter, preferably between about 40 and about 80 microns. The amount of cracking catalyst and nitrogen scavenger present in the FCC unit will be such that the weight ratio of the cracking cracking catalyst to the nitrogen scavenger normally ranges between about 1.5 and about 20, preferably between about 2.33 and about 9.0.

In order to prevent the particles of the nitrogen scavenger from being preferentially eluted from the FCC unit, the particle size and density of the scavenger should be about the same as the particle size and density of the cracking catalyst. If an amorphous aluminosilicate is used as the nitrogen scavenger, it may be necessary to composite the aluminosilicate with a conventional type nonpillared and nondelaminated clay such as kaolin, hectorite, sepiolite or attapulgite, in order to increase the density of the scavenger particles. On the other hand, if the nitrogen scavenger is a pillared clay, delaminated clay or an acid washed natural zeolite, it may be necessary to composite the clay or zeolite with an amorphous aluminosilicate in order to lower the density of the scavenger particles and increase their thermal stability. If the scavenger is composited with another material to adjust its density, it will be understood that the activity of the composited material as defined by equation (1) above will typically be less than about 2.0, preferably less than about 1.5, and most preferably less than about 1.0.

It has been found that, when a nitrogen scavenger as described above is used in combination with a cracking catalyst in an FCC unit, the cracking catalyst becomes effective for cracking feedstocks containing relatively high concentrations of nitrogen, typically concentrations greater than about 0.08 weight percent total nitrogen, calculated as the element. The process of the invention is typically used to treat petroleum derived feedstocks having total nitrogen concentrations ranging between about 0.10 and about 2.0 weight percent, typically between about 0.10 and about 0.50 weight percent, calculated as the element. The process of the invention can also be used to crack feedstocks derived from carbonaceous solids such as coal, oil shale, and tar sands, which feedstocks normally contain nitrogen in concentrations ranging between about 1.0 and about 5.0 weight percent, typically between about 1.5 and about 3.0 weight percent, calculated as the element.

In general, it is preferred that the feedstock to the process of the invention not contain significant concentrations of metals, such as nickel, vanadium, iron, copper and the like. Normally, the concentration of metals in the feedstock is such that the following relationship exists:

$$10[Ni]+[V]+[Fe]<10 \quad (2)$$

where [Ni], [V], and [Fe] are the concentrations of nickel, vanadium and iron, respectively, in parts per million by weight. Preferably the sum of the values on the left hand side of equation (2) above will be less than about 8.0, most preferably less than about 5.0. Also, the concentrations of nickel and vanadium in the feedstock will typically be such that the concentration of nickel in ppmw plus $\frac{1}{4}$ the concentration of vanadium in ppmw is less than about 0.50 ppmw, preferably less than about 0.40 ppmw. In general, the individual concentrations of nickel, vanadium, and copper in the feedstock will be less than about 1.0 ppmw.

The hydrocarbon feedstocks that can be effectively treated using the process of the invention include any hydrocarbon feedstock normally used in cyclic catalytic cracking processes to produce low boiling hydrocarbons which also contains relatively high concentrations of nitrogen. Examples of such feedstocks are vacuum gas oils, atmospheric gas oils, naphtha and the like. Normally, the feed material will have an API gravity in the range between about 18° and about 28°, preferably between about 20° and about 25°. A typical feedstock will contain more than about 70 volume percent liquids boiling above about 650° F. Suitable feedstocks not only include petroleum derived fractions but also hydrocarbon oils derived from coal, oil shale tar sands and similar hydrocarbon-containing solids. The process of the invention is particularly effective in treating shale oils, which normally have concentrations of nitrogen ranging between about 1.0 and about 5.0 weight percent, calculated as the element.

The nature and objects of the invention are further illustrated by the following examples, which are provided for illustrative purposes only and not to limit the invention as defined by the claims. Examples 1 through 3 demonstrate that solids which do not retain pyridine in a vacuum at temperatures up to 300° C. are not effective nitrogen scavengers, whereas solids that retain pyridine in a vacuum when heated to 300° C. substantially increase the activity and selectivity of the cracking catalyst and therefore are effective nitrogen scavengers. Example 4 illustrates that amorphous aluminosilicates having varying concentrations of alumina and silica are active nitrogen scavengers when used in a pure state or when composited with conventional type clays.

EXAMPLE 1

A 15 milligram sample of silica gel particles ranging in size between 100 mesh and 325 mesh on the U.S. Sieve Series Scale and obtained from the Davison Chemical Division of W. R. Grace & Co. is formed into a wafer or disc by pressing the particles on a 13 millimeter diameter die for one minute at about 8000 lbs. The wafer is then mounted in the optical cell of a DuPont 1100 specrometer and degassed by heating at 300° C. for 10 hours at a pressure of 0.10 torr. After heating, the wafer is allowed to cool to room temperature at which time vaporized pyridine is introduced into the optical cell for approximately 15 minutes. After this period of time, the supply of pyridine to the optical cell is terminated and the pyridine-loaded wafer is heated in a vacuum of 0.10 torr to 50° C. The wafer is held in the optical cell at 50° C. for 1 hour after which time an infrared spectrum is taken. Infrared spectra of the silica gel wafer are also taken after the wafer is heated to and held at 100° C. and 200° C., respectively. Analyses of the resultant spectra indicate that the silica gel retains some pyridine at 50° C. but substantially all of the pyridine is desorbed from the silica gel after it is heated at 0.10 torr and 100° C. for 1 hour. The infrared spectra also indicate that the silica gel contains substantially no Bronsted or Lewis acid sites.

EXAMPLE 2

A 15 milligram sample of an amorphous aluminosilicate obtained from the American Cyanamid Company is formed into a wafer in the same manner as described in Example 1. The aluminosilicate contains 22 weight percent alumina and 78 weight percent silica and is comprised of particles ranging in size between 100 and 325 mesh on the U.S. Sieve Series Scale. The aluminosilicate wafer is subjected to the same treatment as the silica gel wafer in Example 1 except that the heating for 1 hour is at 200° C., 300° C. and 400° C., respectively. Inspection of the infrared spectra taken at these three temperatures indicates that a substantial portion of the pyridine is retained on both Lewis and Bronsted acid sites of the amorphous aluminosilicate after heating for 1 hour in a vacuum of 0.10 torr at 200° C., 300° C. and at 400° C. The spectra also indicate that the ratio of Bronsted to Lewis acid sites is greater than about 0.15.

EXAMPLE 3

Samples of the silica gel and amorphous aluminosilicate evaluated for pyridine sorption in Examples 1 and 2 are tested for their effectiveness as nitrogen scavengers during the catalytic cracking of a nitrogen-containing feedstock as follows. A 15 gram sample of GRZ-1 catalyst, a catalyst manufactured by the Davison Chemical Division of W. R. Grace & Co. and commercially sold as a high activity cracking catalyst, is deactivated for testing by treatment in 100 percent flowing steam at 1475° F. for 5 hours. A portion of the deactivated catalyst sample is then evaluated for cracking activity by the standard microactivity test (MAT) method using a feedstock prepared by mixing a commercially available gas oil with an oil having a high concentration of nitrogen. The feedstock thus prepared has an API gravity of 20.9° and contains about 30 volume percent components boiling below about 675° F. and about 70 volume percent components boiling below about 800° F. The feedstock also contains 0.46 weight percent total nitrogen, calculated as the element, and 0.18 weight percent basic nitrogen, calculated as the element. The feedstock further contains 2.5 ppmw iron, 0.4 ppmw nickel, 0.20 ppmw copper and 0.10 ppmw vanadium. The MAT test is carried out at atmospheric pressure and at a temperature of 950° F. utilizing a weight hourly space velocity of 12.0 and a catalyst-to-oil ratio of 3.6. The MAT test as described above is repeated twice except that, prior to deactivation by treatment in 100 percent flowing steam, 10 weight percent of the GRZ-1 catalyst is replaced, respectively, with a portion of the silica gel evaluated for pyridine sorption in Example 1 and with a portion of the amorphous aluminosilicate evaluated for pyridine sorption in Example 2. The results of these three MAT tests are set forth below in Table 1.

TABLE 1

| | | GRZ-1 + 10 Weight % of: | |
|---|---|---|---|
| | GRZ-1 | Silica Gel | Amorphous Aluminosilicate |
| Conversion (Vol. %) | 54.0 | 42.0 | 60.0 |
| Gasoline (Vol. %) | 45.0 | 29.0 | 49.0 |

The data in Table 1 indicate that both the conversion and gasoline yield obtained when a portion of the GRZ-1 catalyst is replaced with silica gel decreased drastically from 54.0 to 42.0 volume percent and from 45.0 to 29.0 volume percent, respectively, thereby indicating that the silica gel acts as an inert diluent. Replacing a portion of the GRZ-1 catalyst with the amorphous aluminosilicate, on the other hand, significantly increased the conversion and gasoline production. It is theorized that the silica gel, which has a poor sorptive capacity for pyridine as indicated in Example 1, was unable to sorb nitrogen compounds from the feedstock and thereby prevent them from poisoning the cracking catalyst. Since the amorphous aluminosilicate is a good sorbent for pyridine, as indicated in Example 2, it is theorized that it preferentially sorbed the nitrogen compounds from the feedstock and thereby prevented them from deactivating the GRZ-1 catalyst. The amorphous aluminosilicate has a lower catalytic activity as defined by equation (1) than does GRZ-1 catalyst and therefore it is quite surprising that replacing a portion of the more active catalyst with the less active aluminosilicate results in increases, let alone such large increases, in conversion and gasoline production.

EXAMPLE 4

A 15 gram sample of Nova-D catalytic cracking catalyst, which is commercially sold as an octane catalyst by the Davison Chemical Division of the W. R. Grace & Co., is deactivated for activity testing by treatment in 100 percent flowing steam at 1475° F. for 5 hours. The deactivated Nova-D catalyst is evaluated for cracking activity by the standard MAT method using as a feedstock a gas oil having an API gravity of 24.8° and containing about 30 volume percent components boiling below 670° F. and about 95 volume percent components boiling below 950° F. The feedstock also contains 0.26 weight percent total nitrogen, calculated as the element, and 0.067 weight percent basic nitrogen, calculated as the element. The feedstock further contains less than 0.5 ppmw nickel, vanadium and copper, respectively, and less than 1.0 ppmw iron. The MAT test is carried out at atmospheric pressure and at a temperature of 950° F. utilizing a weight hourly space velocity between 14.0 and 14.5 and a catalyst-to-oil ratio of about 3.3. The MAT test is repeated a number of times in the manner described above except that in each test 10 weight percent of the Nova-D cracking catalyst is replaced, respectively, with pure alumina, amorphous aluminosilicates containing varying concentrations of alumina and silica, a catalyst matrix containing kaolin dispersed in an aluminosilicate and a catalyst matrix containing kaolin dispersed in alumina. The three amorphous aluminosilicates tested contain, respectively, 80 weight percent alumina and 20 weight percent silica, 55 weight percent alumina and 45 weight percent silica, and 25 weight percent alumina and 75 weight percent silica. These three aluminosilicates are manufactured and sold by the American Cyanamid Company. The results of the above-described MAT tests are set forth below in Table 2.

TABLE 2

| | | Nova-D + 10 Weight % of: | | | | | |
|---|---|---|---|---|---|---|---|
| | Nova-D | $Al_2O_3$ | 80/20 wt. % $Al_2O_3/SiO_2$ | 55/45 wt. % $Al_2O_3/SiO_2$ | 25/75 wt. % $Al_2O_3/SiO_2$ | Matrix* No. 1 | Matrix** No. 2 |
| Conversion (Vol. %) | 69.0 | 69.5 | 73.1 | 71.2 | 71.6 | 73.1 | 71.1 |
| Gasoline (Vol. %) | 56.0 | 52.1 | 60.0 | 62.7 | 61.7 | 62.2 | 56.8 |
| Coke (Weight %) | 3.5 | 4.2 | 4.0 | 3.9 | 3.6 | 4.0 | 3.8 |
| Hydrogen (Scf/b) | 80 | 102 | 76 | 87 | 69 | 75 | 77 |

*Matrix No. 1 contains kaolin dispersed in an aluminosilicate gel.
**Matrix No. 2 contains kaolin dispersed in alumina.

As can been seen from Table 2, the use of Nova-D catalyst alone to crack the nitrogen-containing feedstock resulted in a 69.0 volume percent total conversion of the feedstock with a 56.0 volume percent conversion to gasoline. Replacing 10 weight percent of the Nova-D catalyst with pure alumina had little effect on conversion and decreased gasoline production by about 4 volume percent. Obviously, the alumina did not serve as an effective nitrogen scavenger. The various amorphous aluminosilicates, however, appear to be very good nitrogen scavengers. The use of the amorphous aluminosilicates in combination with the Nova-D catalyst increased conversion from 69.0 to between 71.2 and 73.1 volume percent and significantally increased gasoline production from 56.0 volume percent to between 60.0 and 62.7 volume percent. This large increase in gasoline production is totally unexpected in view of the fact that 10 weight percent of the cracking catalyst itself was replaced by a material that is less active and selective.

The data in Table 2 indicate that the use of the catalyst matrix 1 resulted in conversion and gasoline productions similar to those obtained using the aluminosilicates. Since matrix 1 is composed of an amorphous aluminosilicate and kaolin clay, the data indicate that the presence of the clay has little effect on the nitrogen scavenging ability of the aluminosilicate. Catalyst matrix 2, unlike matrix 1, increased conversion only slightly and gasoline make hardly at all. This matrix contains kaolin clay dispersed in an alumina binder. Since the conversions and gasoline make obtained with pure alumina are relatively poor, it is believed that its presence in catalyst matrix 2 was responsible for the decreased conversions and gasoline production.

It will be apparent from the foregoing that the invention provides a process for the catalytic cracking of nitrogen contaminated feedstocks in which the cracking catalyst maintains a relatively high activity and selectivity for gasoline. The nitrogen tolerance of the catalyst results in longer run times between catalyst changeovers and the need for less makeup catalyst. Also, since a portion of the cracking catalyst is replaced with a less expensive nitrogen scavenger, the total catalysts cost are reduced. These factors in turn result in lower cost operations.

Although this invention has been primarily described in conjunction with examples and by reference to embodiments thereof, it is evident that many alternatives, modifications and variations will be apparent to those skilled in the art in light of the foregoing description. Accordingly, it is intended to embrace within the invention all such alternatives, modifications and variations that fall within the spirit and scope of the appended claims.

I claim:

1. A process for the catalytic cracking of a hydrocarbon feedstock containing nitrogen compounds in an amount such that said feedstock contains greater than about 0.08 weight percent total nitrogen, calculated as the element, which process comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a zeolitic molecular sieve having cracking activity dispersed in a matrix and said nitrogen scavenger comprises a nonzeolitic molecular sieve or a heat stable metal compound selected from the group consisting of magnesium, calcium, zirconium, boron, phosphorus and tungsten compounds, and wherein the concentration of metals in said hydrocarbon feedstock is such that the following relationship exists $$10[Ni]+[V]+[Fe] \text{ is less than about } 8.0$$

where [Ni], [V] and [Fe] are the concentrations of nickel, vanadium and iron, respectively, in parts per million by weight.

2. A process as defined in claim 1 wherein said cracking catalyst consists essentially of a zeolitic molecular sieve having cracking activity dispersed in a matrix.

3. A process as defined in claim 1 wherein said nitrogen scavenger comprises a nonzeolitic molecular sieve and substantially no zeolitic molecular sieve.

4. A process as defined by claim 1 wherein said nitrogen scavenger comprises a heat stable metal compound selected from the group consisting of magnesium oxide, phosphorus oxide, boron oxide, zirconium oxide, tungsten oxide and mixtures thereof.

5. A process as defined by claim 1 wherein said nitrogen scavenger comprises a nonzeolitic molecular sieve.

6. A process as defined by claim 5 wherein said nonzeolitic molecular sieve comprises a pillared clay.

7. A process as defined by claim 6 wherein said pillared clay comprises a pillared montmorillonite.

8. A process as defined by claim 5 wherein said nonzeolitic molecular sieve comprises a delaminated clay.

9. A process as defined by claim 8 wherein said delaminated clay comprises a delaminated synthetic hectorite.

10. A process as defined by claim 5 wherein said nonzeolitic molecular sieve comprises a crystalline silicoaluminophosphate.

11. A process as defined by claim 5 wherein said nonzeolitic molecular sieve comprises a crystalline silica polymorph.

12. A process as defined by claim 11 wherein said crystalline silica polymorph comprises silicalite.

13. A process as defined by claim 5 wherein said nonzeolitic molecular sieve comprises a crystalline aluminophosphate.

14. A process as defined by claim 5 wherein said nonzeolitic molecular sieve comprises a crystalline borosilicate.

15. A process as defined by claim 5 wherein said nonzeolitic molecular sieve comprises a crystalline galliosilicate.

16. A process as defined by claim 1 wherein said matrix comprises a porous, inorganic, refractory oxide and a nonpillared, nondelaminated clay and said nitrogen scavenger is dispersed in a matrix comprising a nonpillared, nondelaminated clay.

17. A process as defined by claim 6 wherein said pillared clay is dispersed in an amorphous aluminosilicate.

18. A process as defined by claim 8 wherein said delaminated clay is dispersed in an amorphous aluminosilicate.

19. A process as defined in claim 1 wherein said hydrocarbon feedstock is derived from petroleum and contains between about 0.10 and about 0.50 weight percent total nitrogen, calculated as the element.

20. A process as defined by claim 1 wherein said hydrocarbon feedstock comprises shale oil and contains between about 1.0 and about 5.0 weight percent total nitrogen, calculated as the element.

21. A process for the catalytic cracking of a hydrocarbon feedstock containing nitrogen compounds in an amount such that said feedstock contains greater than about 0.08 weight percent total nitrogen, calculated as the element, which process comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a molecular sieve having cracking activity dispersed in a matrix and said nitrogen scavenger comprises a particulate amorphous aluminosilicate, and wherein the weight ratio of the cracking catalyst to said nitrogen scavenger in said cracking zone is between about 1.5 and about 20.

22. A process as defined by claim 21 wherein the concentration of metals in said hydrocarbon feedstock is such that the following relationship exists $$10[Ni]+[V]+[Fe] \text{ is less than about } 8.0$$

where [Ni], [V] and [Fe] are the concentrations of nickel, vanadium and iron, respectively, in parts per million by weight.

23. A process as defined by claim 22 wherein said amorphous aluminosilicate contains about 55 weight percent alumina and about 45 weight percent silica.

24. A process as defined by claim 22 wherein said weight ratio of said catalyst to said scavenger is between about 2.33 and about 9.0.

25. A process as defined by claim 22 wherein said amorphous aluminosilicate contains between about 20 weight percent and about 80 weight percent alumina and between about 20 weight percent and about 80 weight percent silica.

26. A process as defined by claim 22 wherein said nitrogen scavenger comprises said amorphous aluminosilicate dispersed in a nonpillared, nondelaminated clay.

27. A process as defined in claim 24 wherein said clay is selected from the group consisting of kaolin, hectorite, sepiolite and attapulgite.

28. A process as defined by claim 22 wherein said hydrocarbon feedstock contains between about 0.10 and about 0.50 weight percent total nitrogen, calculated as the element.

29. A process as defined by claim 22 wherein said molecular sieve is dispersed in a matrix comprising a porous, inorganic, refractory oxide and a nonpillared, nondelaminated clay.

30. A process as defined by claim 22 wherein said nitrogen scavenger consists essentially of said particulate amorphous aluminosilicate and clay.

31. A process as defined in claim 22 wherein said cracking catalyst consists essentially of said molecular sieve having cracking activity dispersed in a matrix.

32. A process as defined by claim 22 wherein said nitrogen scavenger comprises said particulate amorphous aluminosilicate and substantially no molecular sieve.

33. A process as defined by claim 22 wherein said hydrocarbon feedstock contains greater than about 0.10 weight percent total nitrogen, calculated as the element.

34. A process for the catalytic cracking of a hydrocarbon feedstock containing nitrogen compounds in an amount such that said feedstock contains greater than about 0.08 weight percent total nitrogen, calculated as the element, which process comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a molecular sieve having cracking activity dispersed in a matrix and said nitrogen scavenger comprises an amorphous aluminosilicate, and wherein the activity and selectivity of the cracking catalyst is greater than the activity and selectivity of said catalyst when separate particles of substantially pure alumina are used as said nitrogen scavenger in lieu of said amorphous aluminosilicate under substantially the same cracking conditions, wherein the weight ratio of the cracking catalyst to said nitrogen scavenger in said cracking zone is between about 1.5 and about 20.

35. A process as defined by claim 34 wherein said cracking catalyst consists essentially of a molecular sieve having cracking activity dispersed in a matrix.

36. A process as defined by claim 34 wherein said nitrogen scavenger comprises said amorphous aluminosilicate and substantially no molecular sieve.

37. A process for the catalytic cracking of a hydrocarbon feedstock containing nitrogen compounds in an amount such that said feedstock contains greater than about 0.08 weight percent total nitrogen, calculated as the element, which process comprises contacting said feedstock in the vapor phase, without first treating said feedstock to remove at least a portion of said nitrogen compounds, with a mixture of a regenerated cracking catalyst and separate particles of a nitrogen scavenger under cracking conditions in the substantial absence of added molecular hydrogen in a cracking zone to convert components of said feedstock into lower molecular weight constituents, wherein said regenerated cracking catalyst comprises a zeolitic molecular sieve having cracking activity and a pore size of about 8.1 Angstroms dispersed in a matrix and said particulate nitrogen scavenger comprises a zeolitic molecular sieve having a pore size less than about 7.0 Angstroms, and wherein the concentration of metals in said hydrocarbon feedstock is such that the following relationship exists $$10[Ni]+[V]+[Fe] \text{ is less than about } 8.0$$

where [Ni], [V] and [Fe] are the concentrations of nickel, vanadium and iron, respectively, in parts per million by weight.

38. A process as defined by claim 37 wherein said zeolitic molecular sieve having a pore size less than about 7.0 Angstroms comprises a member of the ZSM-5 family of zeolites.

39. A process as defined by claim 38 wherein said zeolitic molecular sieve having a pore size less than about 7.0 Angstroms comprises ZSM-5 zeolite.

40. A process as defined by claim 37 wherein said zeolitic molecular sieve having a pore size less than about 7.0 Angstroms comprises ferrierite.

41. A process as defined by claim 37 wherein said zeolitic molecular sieve having a pore size less than about 7.0 Angstroms comprises offretite.

42. A process as defined by claim 37 wherein said cracking catalyst consists essentially of a zeolitic molecular sieve having cracking activity and a pore size of about 8.1 Angstroms dispersed in a matrix.

43. A process as defined by claim 37 wherein said nitrogen scavenger comprises a zeolitic molecular sieve having a pore size less than about 7.0 Angstroms and substantially no zeolitic molecular sieve having a pore size of about 8.1 Angstroms.

44. A process as defined by claim 37 wherein said hydrocarbon feedstock is derived from petroleum and contains between about 0.10 and about 0.50 weight percent total nitrogen, calculated as the element.

* * * * *

UNITED STATES PATENT AND TRADEMARK OFFICE

CERTIFICATE OF CORRECTION

PATENT NO. : 4,708,786

DATED : 11/24/87

INVENTOR(S) : Mario L. Occelli

It is certified that error appears in the above-identified patent and that said Letters Patent is hereby corrected as shown below:

Claim 27, col. 16, line 30, delete "24" and insert in place thereof --26--.

Signed and Sealed this

Twenty-first Day of June, 1988

*Attest:*

*Attesting Officer*

DONALD J. QUIGG

*Commissioner of Patents and Trademarks*